United States Patent [19]

Adams

[11] 3,950,793

[45] Apr. 20, 1976

[54] BATHTUB BOOK STAND

[76] Inventor: John F. Adams, 55 Lee Road, Chestnut Hill, Mass. 02167

[22] Filed: Oct. 21, 1974

[21] Appl. No.: 516,760

[52] U.S. Cl. ..... 4/1; 4/185 AB
[51] Int. Cl.[2] ..... F16M 13/00
[58] Field of Search..... 248/441 A, 441 R, 445, 248/453, 454; 108/6, 152; 4/1, 185 AB, 185 R

[56] References Cited

UNITED STATES PATENTS

| | | | |
|---|---|---|---|
| 853,184 | 5/1907 | Miller | 248/454 |
| 2,006,169 | 6/1935 | Harris-Jones | 4/1 |
| 2,714,728 | 8/1955 | Bloch | 248/226 B X |
| 3,239,850 | 3/1966 | Kiss | 4/185 R |
| 3,664,629 | 5/1972 | Reed | 248/441 A |
| 3,809,352 | 5/1974 | Mathias | 248/441 A |

FOREIGN PATENTS OR APPLICATIONS

| | | | |
|---|---|---|---|
| 524,002 | 7/1940 | United Kingdom | 248/454 |

*Primary Examiner*—William H. Schultz
*Attorney, Agent, or Firm*—Thompson, Birch, Gauthier & Samuels

[57] ABSTRACT

A bathtub book stand adapted to be mounted on a bathtub to support a book or magazine being read by a person sitting in the tub. The stand has a horizontal support beam extending across the tub. A flat book support member with a lower retaining lip is attached to the horizontal beam and can be tilted at varying angles.

7 Claims, 3 Drawing Figures

BATHTUB BOOK STAND

BACKGROUND OF THE INVENTION

A need has long existed for a device which could be conveniently used by a person sitting in a filled bathtub for the purpose of securely holding reading material in position to be easily read by the bather. Such a device must keep the reading material dry and must prevent its accidental dislodgment into the bath water.

The device must be inexpensive to manufacture, compact for shipping, easy to mount on the bathtub, and stable in use. It should be an appealing gift item, as well as an attractive item to purchase for self-use.

SUMMARY OF THE INVENTION

The book stand has a horizontal support beam which extends across the width of the bathtub. A clamping means is provided on the horizontal beam to clamp the beam to the outer rim of the tub.

A book support member is attached to the horizontal beam and is adjustable to vary its tilt angle. The book support member has a lower retaining lip which holds the book in place and prevents the pages from unintentionally turning.

DESCRIPTION OF THE PREFERRED EMBODIMENT

Figure 1:
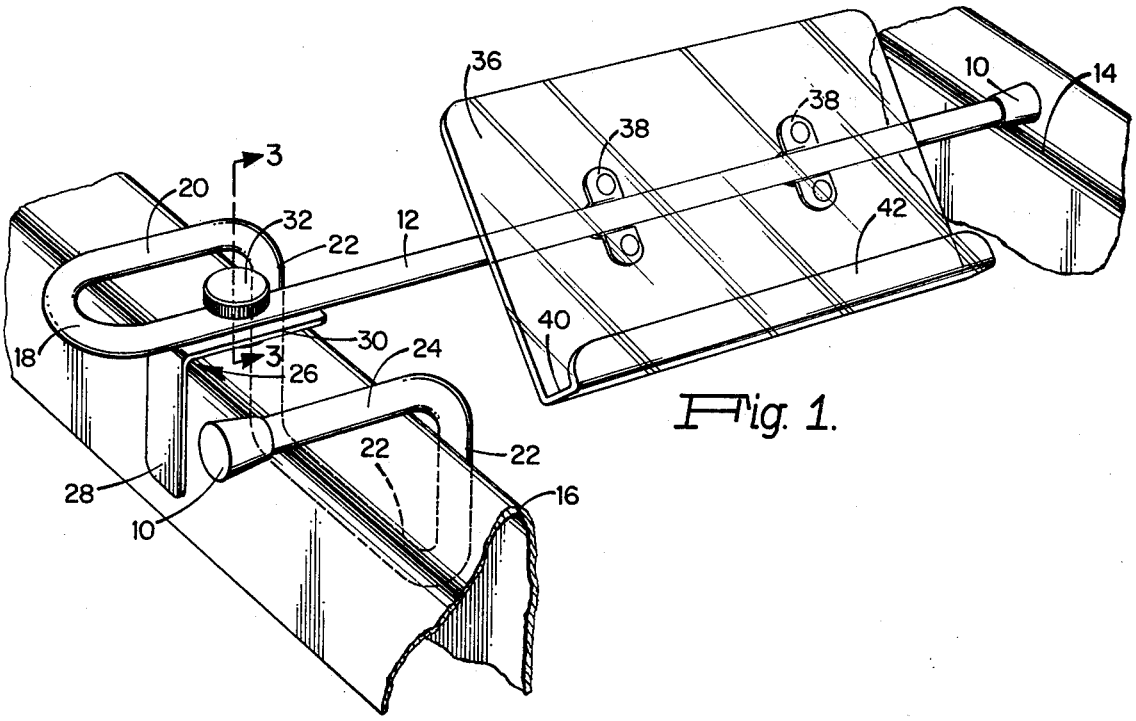
FIG. 1 is a perspective view of the book stand of this invention.
Figure 2:
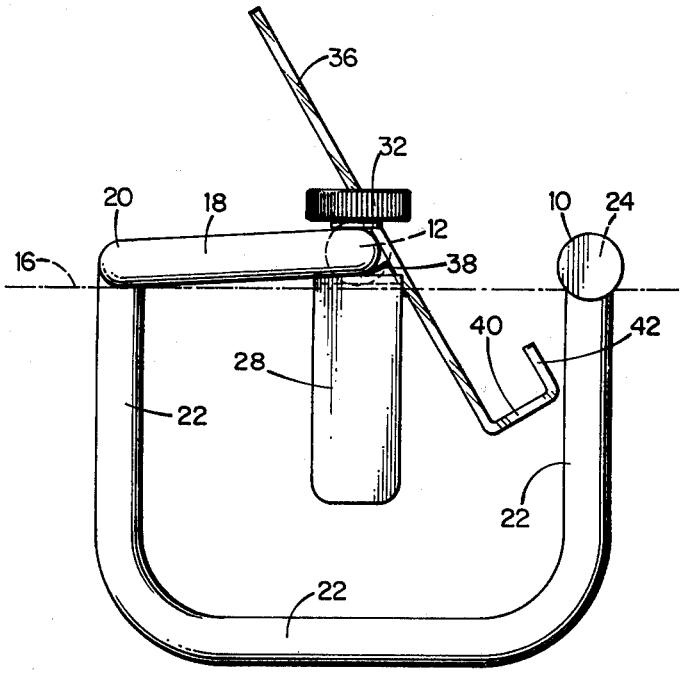
FIG. 2 is an end elevation of the book stand.
Figure 3:
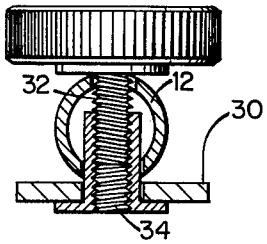
FIG. 3 is a section taken along line 3—3 of FIG. 1.

The bathtub book stand is preferably made of ¾ inch diameter hollow aluminum tubing which has been bright-dipped and clear anodized. The initially straight hollow tubing is bent into the shape shown in FIG. 1 and is capped at both ends with rubber or plastic caps 10, for purposes of safety and to prevent marring of the bathtub finish.

The stand has a horizontal support beam 12 which preferably has a length of at least 27 inches (68.6 cm.) to enable it to span the width of the interior of a conventional bathtub. The horizontal support beam 12 preferably rests upon the upper surface of the inner tub rim 14 and extends to or rests upon the upper surface of the outer tub rim 16. It is not necessary that support beam 12 should rest upon inner tub rim 14. It is sufficient if the support beam extends across at least one-half of the width of the bathtub.

The outer end of horizontal support beam 12 is provided with a means for securing the horizontal beam 12 to the outer tub rim 16. In the preferred embodiment, horizontal beam 12 has an extension 18 which is bent so as to have a first horizontal portion 20, a vertical U-shaped portion 22, and a second horizontal portion 24. Horizontal portions 20 and 24 prevent the horizontal support beam 12 from rotating about its longitudinal axis. Vertical U-shaped portion 22 is positioned against the inner side of outer tub rim 16 to prevent the horizontal support beam 12 from moving outwardly along its longitudinal axis and to provide a long bearing or clamping surface to support horizontal beam 12.

In order to clamp the horizontal beam 12 to the outer tub rim 16, a movable clamping jaw 26 is slidably mounted on the underside of the junction between beam 12 and beam extension 18. Clamping jaw 26 is an L-shaped element with a vertical jaw 28 and a horizontal slide 30. L-shaped element 26 is preferably provided with pads on its surfaces which contact the bathtub. Clamping jaw 26 cooperates with U-shaped portion 22 to clamp outer tub rim 16 therebetween.

The horizontal slide 30 is longitudinally slotted to accommodate the shafts of a threaded bolt 32 and an internally threaded inverted T-nut 34 into which bolt 32 is engaged. The head of the T-nut has an upwardly extending projection which rides in the slot of slide 30 to prevent the T-nut from rotating. When the head of bolt 32 is manually tightened, the clamping jaw 26 is immobilized. When the head of bolt 32 is manually loosened, the clamping jaw 26 is slidable towards or away from vertical U-shaped portion 22 which constitutes a fixed clamping jaw.

In order to securely hold a book, magazine, cosmetics or the like, a planar book support member 36 is attached to horizontal support beam 12. Preferably, the attachment is adjustable so that the angle of book support member 36 can be conveniently varied by the bather. FIG. 1 shows two roughened metal straps 38 which encircle support beam 12 and which are bolted to support member 36. The two straps frictionally hold support member 36 securely in position, yet permit the support member to be selectively tilted under manual pressure. Also, support member 36 can be moved laterally along beam 12 under manual pressure for centering, reversing or other purposes.

The planar book support member 36 is preferably formed from a clear rigid plastic material (such as Plexiglas acrylic resin plastic made and sold by Rohm & Haas Co.). Member 36 is initially a flat approximately square piece which is heated and then bent into the shape shown in FIG. 1. The lower margin is formed into an upturned edge 40 and a page retaining lip 42. Upturned edge 40 is approximately perpendicular to member 36 and retaining lip 42 is approximately parallel to and spaced from member 36.

The book or magazine is intended to be inserted between support member 36 and retaining lip 42. The book is restrained from falling into the bath water by upturned edge 40, and the book's pages are prevented from unintentionally turning by retaining lip 42.

In use, the person who is preparing to take a bath first untightens bolt 32 and slides movable clamping jaw 26 away from vertical U-shaped portion 22. Then, the entire unit is moved downwardly so that horizontal support member 12 spans the tub, with the free end (and cap 10) of support member 12 resting upon inner tub rim 14, and with horizontal slide 30 resting upon outer tub rim 16. Then the vertical jaw 28 is moved toward vertical U-shaped portion 22 to lightly grip the outer tub rim 16 therebetween. Tightening of bolt 32 locks the book stand in place. The reading material may then be inserted on book support member 36. After bathing, the entire unit can easily be removed by lifting it vertically, without untightening bolt 32.

The distance between cap 10 on the free end of support member 12 and vertical U-shaped portion 22 should preferably be at least 27 inches so that the book stand will fit virtually all bathtubs in use today. If the tub is unusually wide, the book stand will operate perfectly well without the free end of member 12 being in any way supported. However, if it is supported by inner tub rim 14, stability is somewhat increased.

It will be understood that other means for securing the horizontal support beam 12 to the outer tub rim 16 are envisioned as being within the scope of this invention. For example, suction cups or fixed brackets could be used. Also, other forms of planar book support members are contemplated, such as links, mesh or other non-solid back rests. Finally, other book holding means are envisioned, such as elastic straps, clips, fingers or covers.

The above description obviously suggests many possible variations and modifications of this invention which would not depart from its spirit and scope. It should be understood, therefore, that the invention is not limited in its application to the details of structure specifically described or illustrated and that within the scope of the appended claims, it may be practiced otherwise than as specifically described or illustrated.

I claim:

1. A bathtub book stand comprising:

a. a horizontal support beam disposed across at least one-half of the width of a bathtub;

b. means for securing one end of said horizontal support beam to at least one bathtub rim to stabilize the book stand thereon, said securing means including two downwardly extending clamping jaws adapted to grip a bathtub rim therebetween, one of said jaws being adjustably movable towards the other of said jaws;

c. a substantially planar book support member including a rigid flat sheet having an upturned edge at its lower margin, said edge extending substantially perpendicular to said sheet, said upturned edge having a page retaining lip at its upper margin, said page retaining lip extending substantially perpendicular to said upturned edge, and extending substantially parallel to and being spaced from said sheet; and d. means for attaching said book support member to said horizontal beam, and for adjustably varying the angle of the position of said book support member.

2. The bathtub book stand of claim 1 wherein said planar book support member is substantially transparent.

3. The bathtub book stand of claim 1 wherein said horizontal support beam comprises means for resting upon the inner and outer rims of the bathtub.

4. The bathtub book stand of claim 1 wherein said horizontal beam has a length which exceeds 27 inches (68.6 cm.).

5. The bathtub book stand of claim 1 wherein said rigid flat sheet is substantially rectangular.

6. The bathtub book stand of claim 1 wherein said attaching means and said varying means comprise a single operative mechanism.

7. The bathtub book stand of claim 1 wherein said horizontal support beam and one of said downwardly extending clamping jaws comprise a single structural member.

* * * * *